United States Patent [19]

Deutsch

[11] 4,270,430

[45] Jun. 2, 1981

[54] NOISE GENERATOR FOR A POLYPHONIC TONE SYNTHESIZER

[75] Inventor: Ralph Deutsch, Sherman Oaks, Calif.

[73] Assignee: Kawai Musical Instrument Mfg. Co., Ltd., Hamamatsu, Japan

[21] Appl. No.: 95,896

[22] Filed: Nov. 19, 1979

[51] Int. Cl.[3] ..... G10H 1/08; G10H 5/00

[52] U.S. Cl. ..... 84/1.23; 84/1.24

[58] Field of Search ..... 84/1.01, 1.03, 1.22, 84/1.23, 1.24, 1.25

[56] References Cited

U.S. PATENT DOCUMENTS

| | | | |
|---|---|---|---|
| 3,247,309 | 4/1966 | Campbell | 84/1.03 X |
| 3,794,748 | 2/1974 | Deutsch | 84/1.24 |
| 4,022,098 | 5/1977 | Deutsch et al. | 84/1.03 |
| 4,026,180 | 5/1977 | Tomisawa et al. | 84/1.01 X |
| 4,067,254 | 1/1978 | Deutsch et al. | 84/1.01 |
| 4,085,644 | 4/1978 | Deutsch et al. | 84/1.01 |
| 4,194,427 | 3/1980 | Deutsch | 84/1.24 |

OTHER PUBLICATIONS

D. B. Keele, Jr., "The Design and Use of a Simple Pseudo Random Pink-Noise Generator", J. Audio Engineering Society, vol. 21, (Jan./Feb., 1973), pp. 33-41.

*Primary Examiner*—S. J. Witkowski
*Attorney, Agent, or Firm*—Ralph Deutsch

[57] ABSTRACT

In an electronic musical instrument apparatus is provided for producing a noise-like signal suitable for a variety of musical effect such as the imitation of percussive musical instruments. A noise master data set is created repetitively and independently of tone generation by computing a Fourier algorithm using random values for the Fourier coefficients. The noise master data set is transferred to a noise tone register whose output is sequentially and repetitively read and converted to an analog noise signal. Formant circuitry is used to vary the noise signal's spectrum in a time variant manner and the frequency of an assigned variable frequency clock can be used to vary the spectral bandwidth of the output noise signal.

11 Claims, 4 Drawing Figures

NOISE GENERATOR FOR A POLYPHONIC TONE SYNTHESIZER

BACKGROUND OF THE INVENTION

1. Field of the Invention

This invention relates broadly in the field of electronic musical tone generators and in particular is concerned with the provision for a noise generator in a polyphonic tone synthesizer.

2. Description of the Prior Art

While the majority of musical tones are characterized by a well-defined pitch, there exists a large group of musical instruments which have no clearly defined pitch characteristic. Such instruments include the percussion family. For example, drums, cymbals, maracas, wood blocks, and tamborines. It is well known in the electronic music art that these "unpitched" musical sounds can be imitated using a random noise generator as the primary signal source. Examples of the application of random noise generators in an electronic musical instrument are contained in the U.S. Pat. No. 3,247,307 entitled "Electronic Musical Instrument."

The most common characteristic of noise generators is that they generate a noise signal which is called by the generic name of "white noise." White noise can be defined as a signal which is uniformly and randomly distributed in amplitude and has a power spectrum which is constant per unit bandwidth over the entire frequency region. No musical instrument, or in fact any real physical device, has a signal characteristic that approaches that of a white noise signal type. Instead, the musical instrument's spectrum tends to fall off at high frequencies in a manner similar to the response of a low-pass filter.

Noise signal sources having a spectrum that is not white are frequently called by the generic name of "pink noise." A more limited use of the term pink noise has been applied to a noise signal whose spectrum contains constant power per percentage bandwidth for all frequencies. The broader generic definition of pink noise will be used in the following.

Pink noise generators have been used in conjunction with the analog variety of tone generators, and it is evident that pink noise generators are also desirable adjuncts to digital musical tone generators. A method of generating an analog noise signal is described in the technical article; D. B. Keele, Jr., "The Design and Use of a Simple Pseudo Random Pink-Noise Generator," *J. Audio Engineering Society,* Vol. 21 (January/February 1973) pp. 33–41. The described system starts with a conventional shift register variety of a binary white noise generator. The output random sequence of "0" and "1" signal states are transformed by an analog filter to produce the desired pink noise signal.

It is obvious to those skilled in the art that the binary white noise generator output signals can be processed by a digital filter to produce a source of digital pink noise. One disadvantage to this conventional and straightforward approach is that a digital filter is not a simple and low clost implementation because it requires the use of one or more digital data multipliers.

The present invention provides a novel means for producing pink noise with adjustable spectral responses without using conventional digital filters in a digital tone generator of the type described in U.S. Pat. No. 4,085,644 entitled "Polyphonic Tone Synthesizer." It is a feature of the present invention that a flexible source of a pink noise signal is generatated without the use of either digital or analog filters.

SUMMARY OF THE INVENTION

The present invention is directed to a novel and improved arrangement for producing a noise-like signal having easily adjustable spectral characteristics which can be utilized in a polyphonic tone synthesizer of the type described in U.S. Pat. No. 4,085,644 entitled "Polyphonic Tone Synthesizer."

In brief, this is accomplished by providing a set of randomly generated harmonic coefficients which are employed during a computation cycle during which a master data set of equally spaced waveshape points are computed. The master data set is transferred to a note register in a manner such that the generation of the musical instrument's tone is not interrupted. The data residing in the note register is read out sequentially and periodically at a rate determined by an adjustable frequency clock. The output data is converted to positive values and converted to an analog signal by means of a digital to analog converter. Provision is made for varying the spectral content of the resulting noise-like analog signal by an adjustable formant subsystem.

It is an objective of the present invention to adjust the generated output noise spectrum using the same adjustable formant system employed to obtain sliding formant synthesizer effects as described in the referenced patent.

It is another objective of the present invention to incorporate an adjustable spectral characteristic noise generator into a polyphonic tone synthesizer of the type described in the referenced patent such that noise-like tones can be generated having a musical pitch or alternatively noise can be generated with a spectrum about zero frequency.

BRIEF DESCRIPTION OF THE DRAWINGS

For a better understanding of the invention reference should be made to the accompanying drawings.

FIG. 3 is a schematic diagram of an alternative embodiment of the invention.

DETAILED DESCRIPTION OF THE INVENTION

The present invention is directed to the inclusion of an adjustable spectral characteristic noise generator included as a subsystem of a polyphonic tone synthesizer of the type described in detail in U.S. Pat. No. 4,085,644 entitled "Polyphonic Tone Synthesizer" which is hereby incorporated by reference. In the following description, all portions of the system which have been described in the referenced patent are identified by two digit numbers which correspond to the same numbered elements used in the patent. All blocks which are identified by three digit numbers correspond to elements added to the polyphonic tone synthesizer to implement the improvement of the present invention.

Figure 1:
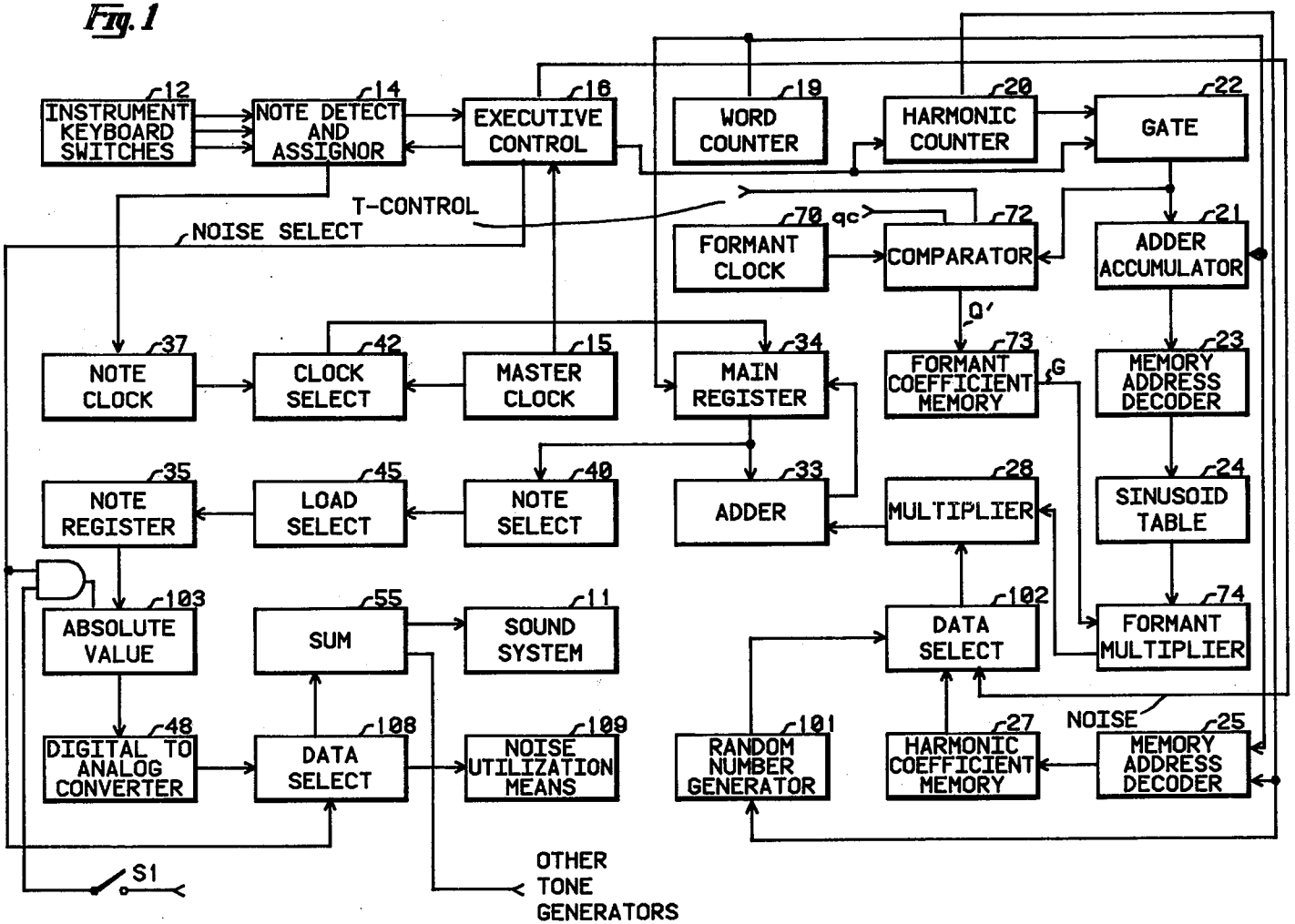
FIG. 1 is a schematic diagram of an embodiment of the invention.

FIG. 1 shows an embodiment of the present invention which generates noise-like signals having adjustable spectral characteristics.

Sound system 11 indicates generally an audio sound system capable of receiving and mixing up to twelve separate audio signals. Each input signal to the sound system is generated by its own tone generator in response to the actuation of a key on a conventional musical keyboard. The keys operate a corresponding keyswitch on the instrument keyboard switches 12. Up to twelve keys may be operated simultaneously to generate as many as twelve simultaneous tones. It will be understood that a polyphonic system having twelve tones is only given by way of example and does not represent a system limitation.

A tone generator consists of the system logic blocks: note clock 37, note register 35, absolute value 103, and digital to analog converter 48. While only one tone generator is shown explicitly in FIG. 1, the remainder consist of identical units as described in the above referenced patent. Each of the tone generators store, in a time allocated manner, the master data set which resides in the main register 34.

Whenever a key on the keyboard actuates a switch, the note detect and assignor 14 stores information corresponding to the particular actuated note on the keyboard and assigns that key to one of the twelve tone generators in the system which is not currently assigned. The note information and the assignment status to a particular tone generator is stored in a memory (not shown) contained in the note detect and assignor 14. The detailed logic and operation of a suitable keyboard note detect and assignor system is described in U.S. Pat. No. 4,022,098 entitled "Keyboard Switch and Assignor" which is hereby incorporated by reference. Other known types of keyboard note detect and assignor systems can also be used.

When one or more keys have been actuated, the executive control 16 initiates a computation cycle during which a master data set consisting of 64 words is computed and stored in the main register 34. The 64 words in the master data set are generated with values which correspond to the amplitudes of 64 equally spaced points for a cycle of the audio waveform of the tone to be produced by the assigned tone generators. The basic manner in which the Polyphonic Tone Synthesizer generates the master data set is described in detail in the referenced U.S. Pat. No. 4,085,644.

At the completion of a computation cycle, the executive control 16 imitiates a transfer cycle during which the master data set stored in the main register 34 is transferred to a note register 35 in the assigned tone generator. The transfer of data to the main register to the note register is accomplished at a rate controlled by the note clock 37 corresponding to the assigned tone generator.

The note clock 37 can be implemented in any of a wide variety of possible adjustable frequency timing clocks. Advantageously the note clocks can be implemented as voltage controlled oscillators. One such implementation in the form of voltage controlled oscillators is described in detail in U.S. Pat. No. 4,067,254 which is hereby incorporated by reference.

The number of data points in a complete master data set, in this case 64 points, is a function of the maximum number of harmonics desired for the output generated tonal structure. The rule is that the maximum number of harmonics is equal to one-half of the number of data points in a complete master data set.

As further described in the above identified U.S. Pat. No. 4,085,644, it is desirable to be able to continuously recompute the master data set which resides in the main register 34 and to keep transferring such data to the note register 35 while the associated key on the keyboard remains depressed or actuated. This is accomplished in a manner which does not interrupt the flow of data point values to the digital to analog converter at the note clock rate. In this fashion of continuous computation and transfer of data, changes in the formant subsystem parameters are heard as smooth tonal variations.

The noise generation system incorporated into FIG. 1 will first be described for the case in which an output noise-like signal is desired which has no defined musical pitch. That is, the noise-like signal is bandwidth limited and has a spectrum containing a low frequency band about zero frequency.

The note detect and assignor 14 is implemented so that one of the 12 tone channels can be switched so that in the switched state it is dedicated to be the noise-like signal generator. It will be apparent from the following that the noise signal generator is almost the same as a normal tone generator and can readily be switched to function either as a normal musical tone generator or as a noise-like signal generator.

Executive control 16 is implemented as described later so that the computation cycle is divided into two major divisions. During the first division of the computation cycle a master data set is computed in the manner described in detail in U.S. Pat. No. 4,085,644. At the conclusion of this first division of the computation cycle, the master data set residing in the main register 34 is transferred in turn to each of the assigned tone generators with the exception of the tone generator that is assigned to function as the noise generator.

After the transfer of the master set data to each of the assigned normal musical tone generators, the executive control 16 initiates the second division of the computation cycle during which a master data set is computed to be used by the assigned noise tone generator.

During the second division of the computation cycle, data select 102 receives a NOISE signal from the executive control 16. In response to the NOISE signal, data select 102 inhibits data read out of the harmonic coefficient memory while transferring data created by the random number generator to the multiplier 28. Thus the second division of the computation cycle is similar to the action that takes place during the first division of the computation cycle with the difference that the output from the random number generator 101 is substituted for the stored set of harmonic coefficients read out from the harmonic coefficient memory 27 by means of the memory address decoder 25.

Figure 2:
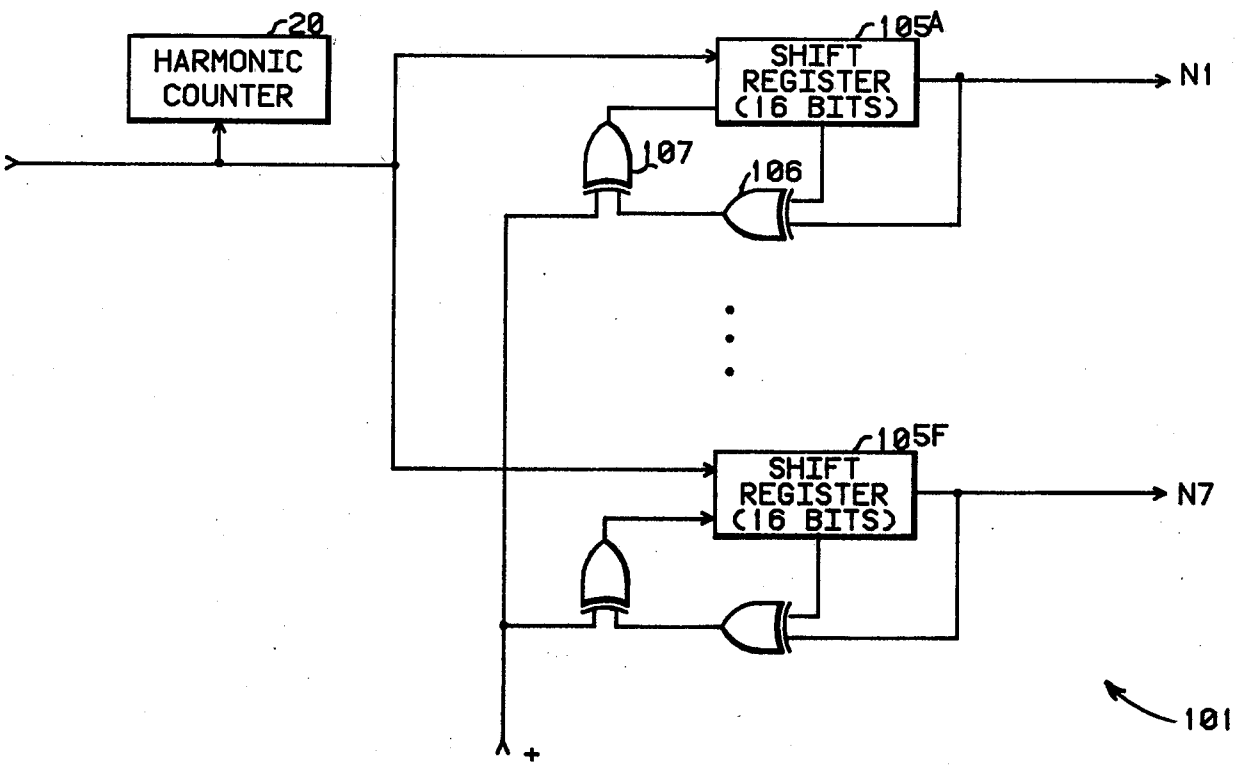
FIG. 2 is a schematic diagram of a random number generator.
Figure 5:
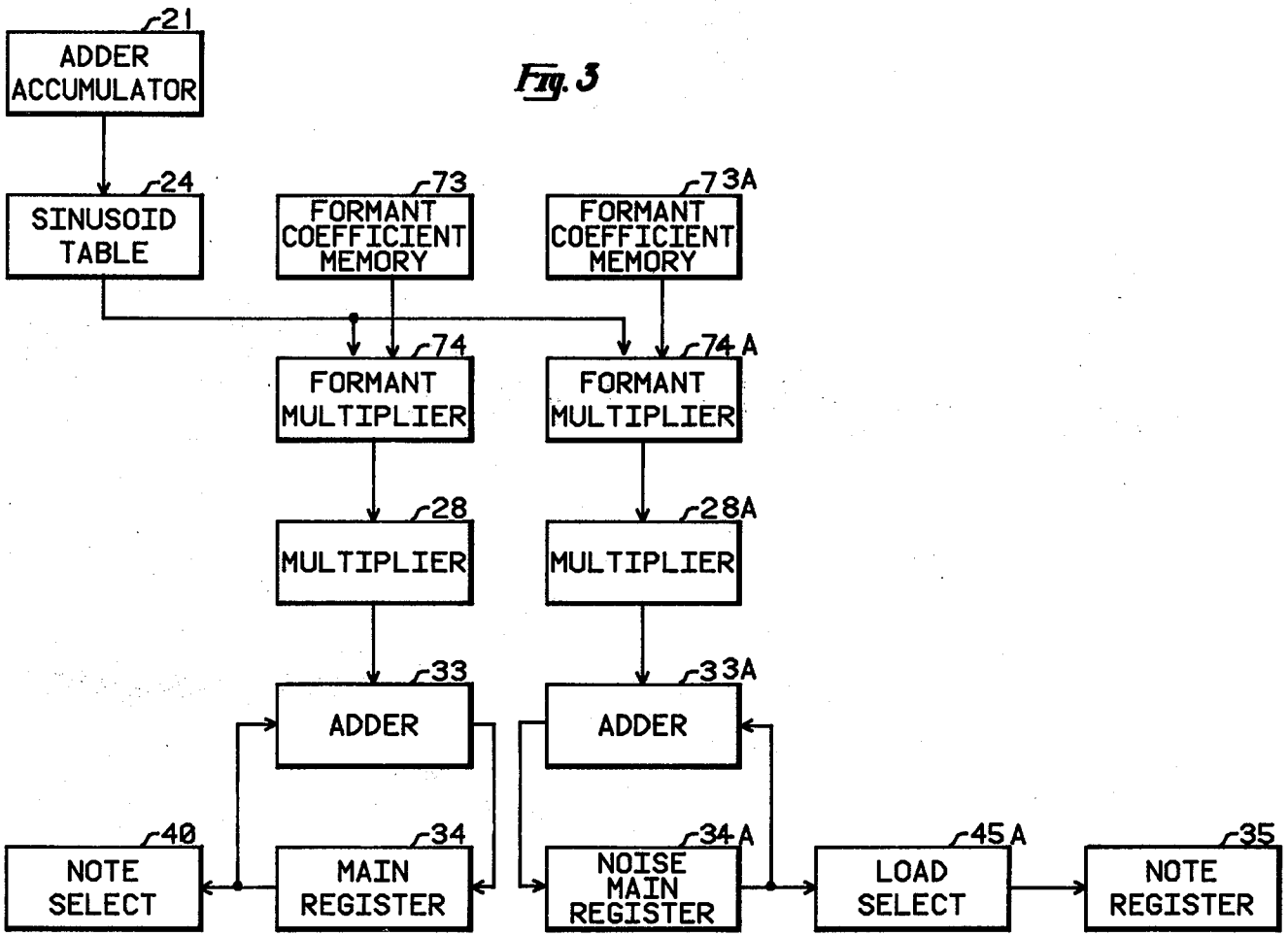

Any of the large variety of state of the art random number generators can be used to implement the random number generator 101. FIG. 2 shows the logic of a suitable implementation of a random number generator using conventional 16 bit shift registers with feedback.

The output from the third stage and the 16th stage of shift register 105A are provided as input signals to EX-OR gate 106. The output signal from the EX-OR gate 106 is provided as one input to the EX-OR gate 107. The second input is maintained at the "1" state by a connection to the power source. The purpose of EX-OR gate 107 is to make the noise generator self-starting when power is applied to the system.

The same signal used to increment the state of the harmonic counter 20 is used to advance the data in the set of shift registers 105A through 105F. The number of such shift registers is equal to the number of binary bits used for the harmonic coefficients stored in the harmonic coefficient memory. For most systems, 7 bits words are sufficient. The output from the random number generator are on the lines shown explicitly as N1 through N7. The sequence of generated random numbers from random number generator 101 will be of length $2^{n-1}-1$ where $n=16$ is the length of the shift register 105A in bits. This is a very large number and the periodicities will occur at very low frequencies and are generally not heard in the sound system 11.

The master data set values computed during the second division of the computation cycle are modified by the output of the formant multiplier 74 in the manner described in the referenced U.S. Pat. No. 4,085,644. Thus the noise master data set, or the master data set computed during the second division of the computation cycle, can be modified in average harmonic content by the same formant subsystem used to generate sliding formants for the normal musical tones.

At the termination of the second division of the computation cycle, the master data set residing in the main register 34 is transferred during a noise transfer cycle to the note register 35. The noise transfer cycle is the same as the usual transfer cycle except that it always follows the conclusion of the second division of the computation cycle and the master data transfer is made to the tone generator that has been assigned as the noise signal generator.

The master data set read out from the note register 35 in response to the note clock 37 is transferred to the digital to analog converter via the absolute value 103. The absolute value circuitry in response to a NOISE SELECT signal from the executive control 16 will cause the absolute value of the input data to be sent to the digital to analog converter 48. The absolute value operation causes the output noise signal to have a low frequency spectrum about the zero frequency value. The absolute value of a data value is the positive magnitude of the value.

Data select 108, in response to the presence of the NOISE SELECT signal, will transfer the output noise-like signal from the digital to analog converter to the noise utilization means 109.

Notice that if the NOISE SELECT signal and NOISE signal are absent, the tone generator shown in FIG. 1 will operate as a conventional musical tone generator.

If the NOISE SELECT signal is not generated then absolute value 103 will be inoperative so that the data read out of the note register 35 is sent without alteration to the digital to analog converter 48. In this case, the output noise-like signal from the data select 108 will have a spectrum clustered about a frequency determined by the note clock 37. The result will be a "noisy" signal tone which has a pitch.

The operation of the formant subsystem is described as follows.

The current value of the q harmonic number as determined by the state of the harmonic counter 20 is sent to the comparator 72 via the gate 22. A value $q_c$ is an input to the comparator 72. $q_c$ is the harmonic number that determines the effective cut-off for a low-pass filter. $q_c$ is an input value to the system which can be supplied by any of a wide variety of numerical input data means. Formant clock 70 provides a prescribed timing means for providing a time varying value u as an input to the comparator 72. At each bit time of the computation cycle, comparator 72 compares the value $q+u$ to the input value of $q_c$. If $q+u$ is less than or equal to $q_c$, a value $Q'=1$ is sent to the formant coefficient memory 73. If at some bit time it is found that $q+u$ is greater than $q_c$, the value $Q'=q+u-q_c$ is transmitted as a data address to the formant coefficient memory 73. In response to the received addresses, a formant coefficient G is accessed out from the formant coefficient memory 73. Formant multiplier 74 multiplies the current value addressed from the sinusoid table 24 by the value of the formant coefficient G. The resultant product is transferred as one input to the multiplier 28.

The previously referenced U.S. Pat. No. 4,085,644 lists suitable values for the formant coefficients stored in the formant coefficient memory 73.

The T-control signal to the comparator 72 is used to determine if either a low pass or high pass filter is to be implemented in a manner described in U.S. Pat. No. 4,085,644.

Instead of using a table of formant coefficients it is an obvious modification to use circuitry for calculating values of the formant coefficient G in response to the output from the comparator 72. For example, a typical set of formant coefficients can be calculated from the relation $$G=\exp\{0.1151\times 40\log_{10}(8/(7+q))\}. \qquad \text{Eq. 1}$$

The output values from the multiplier 28 are called harmonic components as described in U.S. Pat. No. 4,085,644.

FIG. 3 shows an alternative embodiment of the invention to that shown in FIG. 1 and previously described. The system shown in FIG. 3 calculates two independent master data set values during a single computation cycle by using parallel computing chains. The system blocks having an "A" added to their numbers have the same function as their corresponding numbers. The "A" blocks are used to calculate the value of noise master data set.

The independent formant coefficient memories and formant multipliers are used. The net result is that there is independent control of the spectral changes of the musical tones and the noise-like signal output.

The master data set computed during the computation cycle and residing in the main register 34 is transferred during a transfer cycle to all the assigned tone generators with the exception of the assigned noise tone generator. The noise master data set computed during the computation cycle and residing in the noise main register 34A is transferred to the note register 35 which is a component of the assigned noise tone generator.

The formant subsystem shown in FIG. 1 can also be used to provide independent control of the musical tone harmonic spectrum and the noise signal spectrum. This can be done in an obvious time sharing mode of operation such that one set of values are used during the first division of the computation cycle while a second set of values are used during the second division of the computation cycle.

Figure 4:
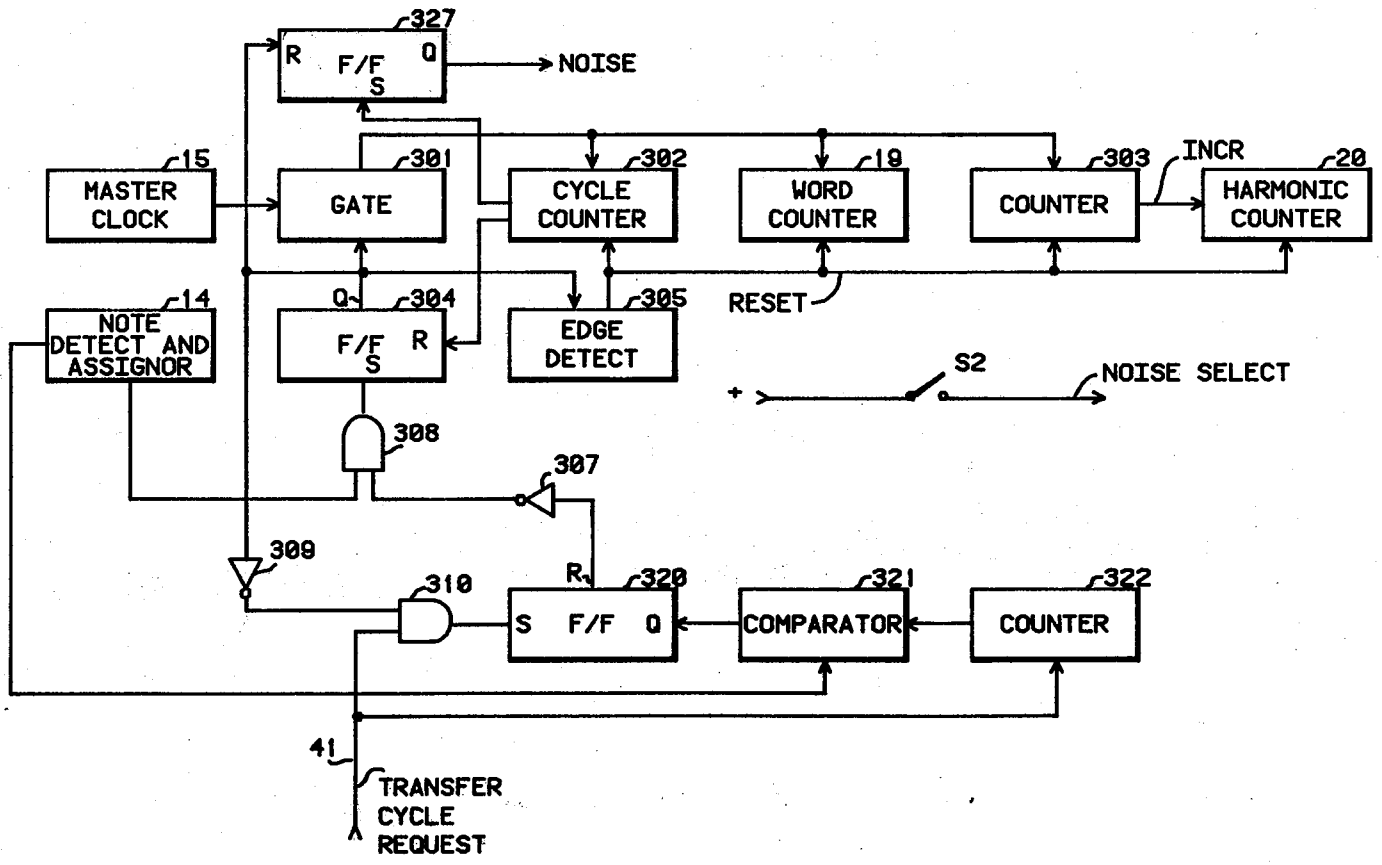
FIG. 4 is a schematic diagram showing details of the executive control.

FIG. 4 shows details of the executive control 16. The system logic blocks in FIG. 4 having labels in the 300-number series are elements of the executive control 16. A complete computation cycle is initiated when flip-flop 304 is set so that its output state is Q="1". Flip-flop 304 can be set at a request from the note detect and assignor 14 if flip-flop 320 has its output state at Q="0". As described below, flip-flop 320 is used to control a transfer cycle and it is desirable that a computation cycle not be initiated while a transfer cycle is in progress. Note detect and assignor 14 will generate a request for the start of a computation cycle if this subsystem has detected that a key has been actuated on the musical instrument's keyboard. An alternative system operation logic is to always initiate a complete computation cycle when a transfer cycle is not in process, or to initiate a computation cycle at the completion of each transfer of data to a tone register.

When flip-flop 304 is set at the start of a complete computation cycle, the output state Q="1" is converted into a signal pulse RESET by means of the edge detect circuit 305. The RESET signal is used to reset counters 302, 19, 303, 322, and 20.

The state Q="1" causes gate 301 to transfer clock timing pulses from the master clock 15 to increment counters 302, 19, and 303. Counter 303 counts modulo 32. Each time the contents of this counter is reset because of the modulo counting implementation an INCR signal is generated. The INCR signal is used to increment the harmonic counter 20.

Flip-flop 327 is reset at the start of a complete computation cycle at the same time that flip-flop 304 is set.

Counter 302 counts the master clock pulses modulo 2048. The first division of the computation cycle is terminated at a count of $P \times H$, where P is the number of data words in the master data set and H is the number of harmonics used to generate a master data set. For the illustrative example, $P=64$ and $H=32$ so that the first segment of the computation cycle is terminated at a count state of $64 \times 32 = 2048$ for counter 302. When this counter reaches the count 2048 a signal is sent to set the flip-flop 327.

When the flip-flop 327 is set, the output state is Q="1" and is used for the NOISE signal.

When the NOISE signal is "1", the second division of the computation cycle is initiated. The complete computation cycle is terminated at the time counter 302 reaches its maximum count of $2 \times P \times H = 4096$. The modulo reset action of this counter creates a signal which is used to reset flip-flop 304 thereby preventing gate 301 from transferring master clock pulses.

A transfer cycle request on line 41 will set flip-flop 320 if a computation cycle is not in progress as indicated by a state Q="0" from flip-flop 304.

The number of assigned tone generators is transferred from the note detect and assignor 14 to the comparator 321. Counter 322 is incremented by the transfer cycle requests on line 41. This counter is reset at the same time that counter 302 is reset. When the count state of counter 322 is incremented to the number of assigned tone generators in comparator 321, a signal is created which resets flip-flop 320. The state Q="0" of flip-flop 320 permits the start of a new computation cycle upon request from the note detect and assignor 14.

The NOISE SELECT signal is created by the executive control 16 when switch S2 is closed.

The implementation of the absolute value 103 depends upon the particular binary number system used to represent the numerical vaues of the elements of the master data set. These values can be both positive and negative. If the binary system used is that of "signed numbers," then the most significant bit is used to indicate whether the remaining bits are to be associated with a positive or negative value. The usual practice is to make the most significant bit a "1" to indicate a negative value. For signed numbers, the absolute value 103 contains a simple gate for the most significant bit which acts to transfer a "0" state for the most significant bit if the NOISE SELECT signal is in its "1" state.

If the 2's complement binary system is used for the negative values of the master data set points, a "1" for the most significant bit will denote that the binary number represents a negative value. If a "1" is detected for the most significant bit, then absolute value 103 performs a 2's complement on the current input data before transferring the data to the digital to analog converter 48. If a "0" is detected for the most significant bit, then absolute value 103 transfers its input data unaltered to the digital to analog converter 48.

If switch S1 is open the absolute value 103 will be inhibited for the noise generator. In this case a noise-like signal will be generated which has a defined musical pitch determined by the frequency of the assigned note clock 37. If switch S1 is closed, the bandwidth of the low frequency noise will be a function of the musical key to which the note clock 37 is assigned.

I claim:

1. A musical instrument utilizing a noise-like signal generator comprising;

a random number generator for creating a sequence of random data values, a means for computing a noise master data set responsive to said sequence of random data values during each computation cycle of a sequence of computation cycles, a first memory means for writing said noise master data set to be thereafter read out, a second memory means for writing input data to be thereafter read out, means for reading said noise master data set from first memory means and for writing said noise master data set in said second memory means, means for repetitiously and sequentially reading out data stored in said second memory means, absolute value means for generating the absolute values of data read out from said second memory means, and means for converting wherein said generated absolute values of data are converted to provide said noise-like signal.

2. A musical instrument according to claim 1 wherein said means for computing a noise master data set further comprises;

means for separately evaluating each of a set of harmonic components by multiplying one of said sequence of random data values by a sinusoid value, means for accumulating said set of harmonic components thereby forming values of said noise master data set, and means for writing said noise master data set in said first memory means.

3. A musical instrument according to claim 2 further comprising;

a word counter means incremented at each computation time in said computation wherein said word counter means counts the number of data values in said noise master data set and wherein a word reset signal is created when contents of said word counter means is reset to its initial value, a harmonic counter means incremented by said word signal and wherein said harmonic counter means is initialized to its minimum count state at the start of each said computation cycle, a sinusoid table comprising a memory storing values for a period of a sinusoid function, an adder-accumulator means for adding successive values of content of said harmonic counter means, and a memory address recording responsive to contents of said adder-accumulator means whereby sinusoid values are accessed from said sinusoid table and provided to said means for separately evaluating each of a set of harmonic components.

4. A musical instrument according to claim 1 wherein such computing is done digitally with numerical values expressed in a 2's complement binary number system and wherein said absolute value means further comprises;

algebraic sign detection circuitry wherein a minus signal is generated if the most significant bit of said data read out of said second memory means is the binary value "1", and 2's complement circuitry responsive to said minus signal wherein said data read out of said second memory means is transferred unaltered to said means for converting if said minus signal is not generated and wherein said data read out of said second memory means is changed to its corresponding 2's complement form before transfer to said means for converting if said minus signal is generated.

5. A musical instrument according to claim 1 wherein such computing is done digitally with numerical values expressed in a signed binary number system and wherein said absolute value means further comprises;

algebraic sign detection circuitry wherein a minus signal is generated if the most significant bit of said data read out of said second memory means is the binary value "1", and algebraic sign circuitry responsive to said minus signal wherein said data read out of said second memory means is transferred unaltered to said means for converting if said minus signal is not generated and wherein said data read out from said second memory means is altered to have a "0" value for the most significant bit before transfer to said means for converting if said minus signal is generated.

6. A musical instrument according to claim 2 further comprising;

a coefficient memory means for storing a set of formant coefficients, a formant clock providing formant timing signals, a comparator means responsive to said formant timing signals wherein addressing signals are created and used to access formant coefficients from said coefficient memory means, and a formant multiplier means for providing the formant product formed by multiplying said accessed formant coefficient from said coefficient memory means by sinusoid values accessed from said sinusoid table thereby producing spectral variations in said noise master data set.

7. A musical instrument according to claim 6 wherein said coefficient memory means comprises circuitry for computing values of said formant coefficients responsive to signals provided by said comparator means.

8. A musical instrument utilizing a noise-like signal generator comprising;

a keyboard comprising a plurality of key switches, a plurality of tone switches wherein each setting of said tone switches corresponds to a selection of a predetermined sound waveshape, a noise signal generation switch, digital computing means responsive to setting of said tone and noise signal generation switches for generating a master data set having words corresponding to a succession of points on said selected sound waveshape and for generating a noise master data set comprising words having random values, a plurality of registers, a noise signal assignor responsive to said noise signal generator switch whereby a member of said plurality of registers is assigned as a noise tone generator if said noise signal generator switch is actuated, transferring means responsive to the setting of any of said key switches whereby said master data set is transferred from said digital computing means to selected members of said plurality of registers and whereby said noise master data set is transferred to said member of said plurality of registers if said noise generator switch is actuated, a plurality of variable frequency clock generators each associated with a member of said plurality of registers whereby associated registers are shifted at a selected clock rate, means responsive to operation of any member of said plurality of key switches for setting the frequencies of said clock generators to predetermined values assigned to key switches, digital-to-analog convertor means connected to said plurality of registers, first means for repeatedly shifting stored master data set in each member of said plurality of registers not assigned as a noise tone generator serially to said digital-to-analog convertor means in synchronism with said associated clock generator whereby said digital-to-analog converter means generates a plurality of analog output signals each having a fundamental frequency determined by a selected key on said keyboard and a waveshape determined by the setting of said tone switches, and second means for repeatedly shifting stored noise master data set in said assigned noise tone generator in synchronism with said associated clock generator whereby digital-to-analog convertor means generates a noise like signal having a spectral width determined by a selected key on said keyboard.

9. A musical instrument according to claim 8 wherein said second means for repetitively shifting further comprises an absolute value circuitry means responsive to said noise signal generator switch whereby signals provided to said digital-to-analog convertor means are transferred unaltered for positive value signals and are altered to positive values if such signals have negative values.

10. A musical instrument according to claim 8 wherein said digital computing means further comprises, a coefficient memory means for storing a set of formant coefficients, a formant clock providing formant timing signals, a comparator means responsive to said formant timing signals wherein addressing signals are created and used to access formant coefficients from said coefficient memory means, and a formant multiplier means responsisive to formant coefficients accessed from said coefficint memory means wherein said master data set values and said noise master data set values are computed with variable spectral characteristics.

11. A musical instrument according to claim 10 wherein said coefficient memory means comprises circuitry for computing values of said formant coeffients responsive to signals provided by said comparator means.

* * * * *